US005737944A

United States Patent [19]

Nishimura et al.

[11] Patent Number: 5,737,944

[45] Date of Patent: Apr. 14, 1998

[54] WASHING MACHINE WITH IMPROVED DRIVE STRUCTURE FOR ROTATABLE TUB AND AGITATOR

[75] Inventors: Hiroshi Nishimura, Seto; Masaru Koshimizu, Komaki; Masahiro Imai, Tajimi; Koichi Hosomi, Seto; Yutaka Inagaki, Fuji, all of Japan

[73] Assignee: Kabushiki Kaisha Toshiba, Kanagawa-Ken, Japan

[21] Appl. No.: 711,932

[22] Filed: Sep. 11, 1996

[30] Foreign Application Priority Data

Oct. 30, 1995 [JP] Japan ..... 7-282002

[51] Int. Cl.[6] ..... D06F 37/40; D06F 39/08

[52] U.S. Cl. ..... 68/23.7; 68/208

[58] Field of Search ..... 68/23.7, 208

[56] References Cited

U.S. PATENT DOCUMENTS

| | | | |
|---|---|---|---|
| 2,656,702 | 10/1953 | Chapin | 68/23.7 X |
| 4,813,248 | 3/1989 | Smith et al. | 68/23.7 |
| 5,619,871 | 4/1997 | Forbes et al. | 68/23.7 |

FOREIGN PATENT DOCUMENTS

| | | | |
|---|---|---|---|
| 56-34391 | 4/1981 | Japan | D06F 37/40 |
| 60-132592 | 7/1985 | Japan | D06F 37/40 |

*Primary Examiner*—Philip R. Coe

*Attorney, Agent, or Firm*—Limbach & Limbach, LLP

[57] ABSTRACT

A washing machine includes an outer tub, a rotatable tub rotatably mounted in the outer tub, an agitator mounted in the rotatable tub, a hollow tub shaft transmitting a rotating force to the rotatable tub, an agitator shaft inserted in the tub shaft for transmitting a rotating force to the agitator and having a lower end, an electric motor including a stator concentric with the agitator shaft and a rotor mounted on the lower end of the agitator shaft, a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, and a mechanism housing mounted on an outer bottom of the outer tub. The tub shaft, the agitator shaft, the motor and the clutch are mounted on the mechanism housing to be composed into an integral mechanism unit.

13 Claims, 12 Drawing Sheets

WASHING MACHINE WITH IMPROVED DRIVE STRUCTURE FOR ROTATABLE TUB AND AGITATOR

BACKGROUND OF THE INVENTION

1. Field of the Invention

This invention relates to a washing machine with an improved drive structure for driving a rotatable tub and an agitator.

2. Description of the Prior Art

Conventional fully automatic washing machines comprise a rotatable tub rotatably mounted in an outer tub and serving both as a wash tub and as a dehydration basket and an agitator mounted in the rotatable tub. A single electric motor is provided for driving both of the rotatable tub and the agitator. More specifically, in a wash step of the washing operation, a motor speed is decelerated and its rotation is transmitted only to the agitator so that the same is driven repeatedly alternately forward and backward. In a dehydration step, the motor speed is not decelerated and its rotation is transmitted both to the rotatable tub and to the agitator so that both of them are rotated at high speeds.

A rotation transmission path from the motor to the rotatable tub and the agitator includes a belt transmission mechanism and a gear reduction mechanism having planetary gears in the above-described washing machine. These belt transmission mechanism and gear reduction mechanism increase the weight and the height of the washing machine, resulting in an increase in the size thereof. Furthermore, a loud noise is produced during operation of the gear reduction mechanism. Additionally, provision of these mechanisms results in a problem of power transmission loss and requires the adjustment of belt tension.

SUMMARY OF THE INVENTION

Therefore, an object of the present invention is to provide a washing machine wherein the weight, the size thereof, the noise produced therein and a loss in the power transmission can be reduced, and the belt tension adjustment is unnecessary.

The present invention provides a washing machine comprising an outer tub, a rotatable tub rotatably mounted in the outer tub, an agitator mounted in the rotatable tub, a hollow tub shaft transmitting a rotating force to the rotatable tub, an agitator shaft inserted in the tub shaft for transmitting a rotating force to the agitator and having a lower end, an electric motor including a stator concentric with the agitator shaft and a rotor mounted on the lower end of the agitator shaft, a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, the clutch having a change-over member and changing between the first and second modes on the basis of operation of the change-over member, and a mechanism housing mounted on an outer bottom of the outer tub so that the tub shaft, the agitator shaft, the motor and the clutch are mounted on the mechanism housing to be composed into an integral mechanism unit, a drain valve provided for discharging wash liquid, and drain valve drive means for driving the drain valve, the drain valve drive means actuating the change-over member of the clutch.

According to the above-described construction, the agitator shaft and accordingly the agitator are directly rotated by the motor rotor during the wash step, whereas both the tub and agitator shafts and accordingly, both of the agitator and the rotatable tub are directly rotated by the motor rotor in the dehydration step. Thus, since a direct drive structure is provided, neither a belt transmission mechanism nor a gear reduction mechanism is required. Consequently, the weight, the size of the washing machine and noise produced in the washing machine can be reduced. Furthermore, the power transmission loss can be reduced and the belt tension adjustment is unnecessary. Furthermore, since equipments such as the motor are concentrated on a portion of the rotatable tub about its axis, vibrations produced during the dehydration step can be reduced. Furthermore, the tub shaft, the agitator shaft, the motor, and the clutch are mounted on the mechanism housing into an integral mechanism unit. In the mounting of the mechanism unit, these parts are previously composed into the mechanism unit and the mechanism housing is then mounted to the outer tub, whereby the mounting of the mechanism unit can be completed. Consequently, since the parts are assembled all together, the assembling efficiency can be improved.

A control lever may rotatably be mounted on a stationary portion of the machine for actuating the changeover member of the clutch.

The mechanism housing is preferably sized so as to cover the motor and inclined so as to be gradually lowered toward the outside of the machine. Furthermore, the mechanism housing is preferably sized so as to cover the motor and has a drain hole formed in a portion thereof located outside the motor. The change-over member may be pivotable about one of two ends thereof so that the other end side thereof is moved upwardly and downwardly.

The change-over member may be movable upwardly and downwardly and the control lever may have upwardly and downwardly inclined faces moving the change-over member upwardly and downwardly respectively. Furthermore, the change-over member and the stationary portion of the machine may have convex and concave portions respectively, which portions constitute fixing means for fixing the tub shaft to the stationary portion when the convex and concave portions are interfitted.

The change-over member may have a convex portion formed on a lower surface thereof and the motor rotor may have an engaged portion formed in an upper surface thereof. When the change-over member is moved downwardly, the convex portion of the change-over member may be engaged with the engaged portion of the motor rotor so that the tub shaft is operatively coupled to the agitator shaft so that the rotor, the agitator shaft and the tub shaft are rotated together. Alternatively, the change-over member may have a convex portion formed on a lower surface thereof and the motor rotor may be formed with an engaged hole. When the change-over member is moved downwardly, the convex portion of the change-over member may be engaged with the engaged hole of the motor rotor so that the tub shaft is operatively coupled to the agitator shaft so that the rotor, the agitator shaft and the tub shaft are rotated together. Furthermore, the convex portion of the change-over member may have a generally trapezoidal shape and the engaged portion of the motor rotor may include a plurality of convex portions radially protruding from the upper surface of the rotor about an axis thereof. The convex portion of the change-over member may be engaged with one of spaces defined between the convex portions of the rotor when the change-over member is downwardly moved.

In another embodiment, the present invention provides a washing machine comprising an outer tub, a rotatable tub rotatably mounted in the outer tub, an agitator mounted in the rotatable tub, a hollow tub shaft transmitting a rotating force to the rotatable tub, an agitator shaft inserted in the tub shaft for transmitting a rotating force to the agitator and having a lower end, an electric motor including a stator concentric with the agitator shaft and having a winding and a rotor mounted on the lower end of the agitator shaft, a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, an air intake formed in the motor rotor, and a plurality of ribs formed on the rotor so as to be located below the stator winding.

In further another embodiment, the invention provides a washing machine comprising, an outer tub, a rotatable tub rotatably mounted in the outer tub, an agitator mounted in the rotatable tub, a hollow tub shaft transmitting a rotating force to the rotatable tub, an agitator shaft inserted in the tub shaft for transmitting a rotating force to the agitator and having a lower end, an electric motor including a stator concentric with the agitator shaft and a rotor mounted on the lower end of the agitator shaft, a clutch including a holder provided integrally with the tub shaft for rotation therewith, a change-over member provided on the holder to be movable upwardly and downwardly, and a toggle type spring holding the change-over member at each position when the same is moved upwardly or downwardly, the clutch changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, and a stopper provided on the holder for limiting the upward movement of the change-over member. In the above-described construction, the holder of the clutch may have a through hole. The washing machine may further comprise holder fixing means comprising a female thread formed in the tub shaft and a screw which is, after having passed through the hole of the holder, engaged with the female thread so that the holder is fixed to the tub shaft.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
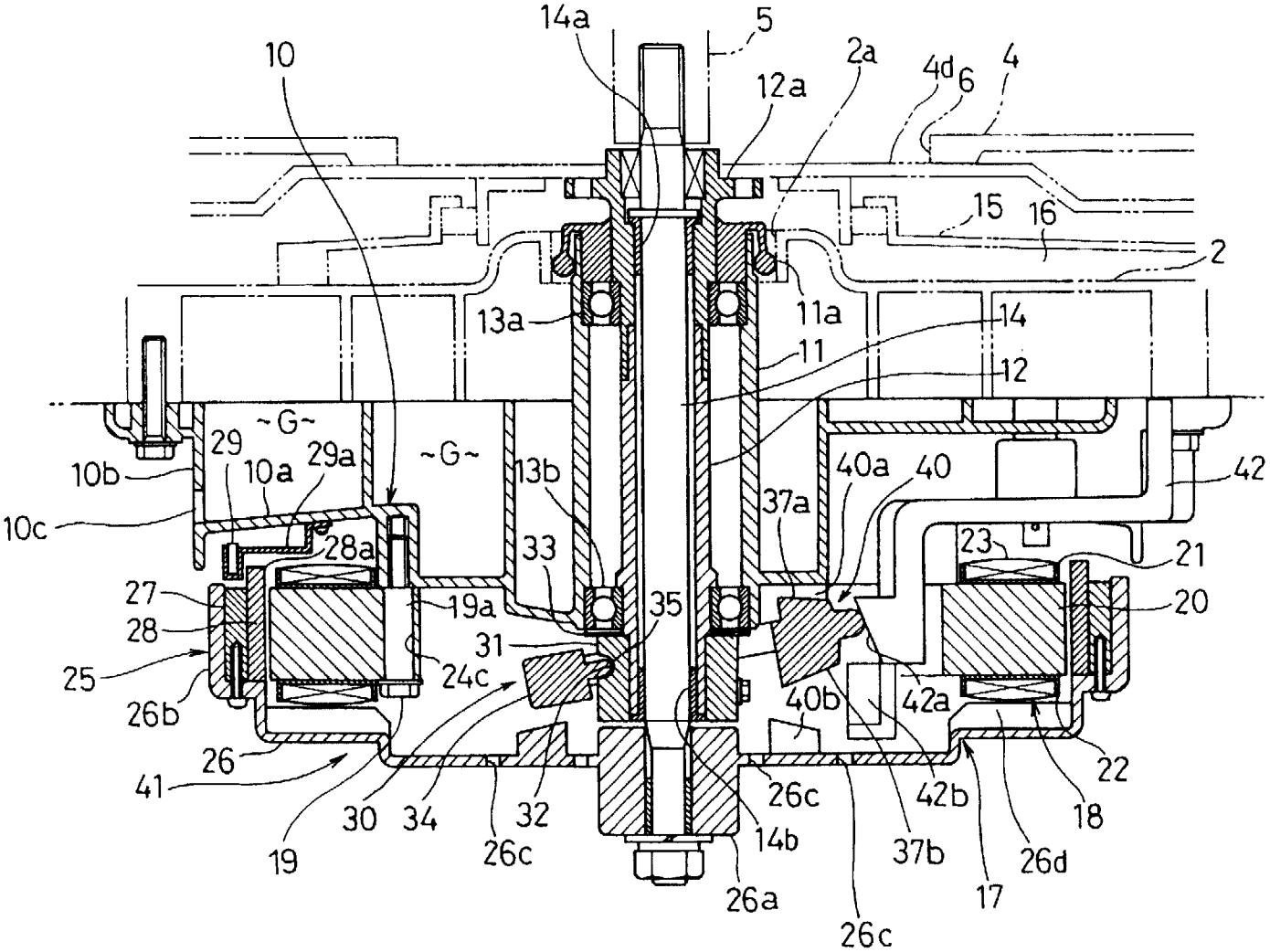
FIG. 1 is a longitudinal side section of a mechanism unit of a washing machine of a first embodiment in accordance with the present invention.

A first embodiment of the present invention will be described with reference to FIGS. 1 to 11. Referring first to FIG. 2, a washing machine of the first embodiment is shown. An outer cabinet 1 encloses a water-receiving tub 2 suspended on a plurality of elastic suspension mechanisms 3 only one of which is shown. The water-receiving tub 2 serves as an outer tub receiving water resulting from a dehydrating operation. A rotatable tub 4 serving both as a wash tub and as a dehydration basket is rotatably mounted in the water-receiving tub 2. An agitator 5 is rotatably mounted on the bottom of the rotatable tub 4. A drive mechanism for the rotatable tub 4 and the agitator 5 will be described later.

The rotatable tub 4 includes a tub body 4a formed into the shape of a gradually upwardly spreading tapered cylinder, an inner cylinder 4*b* provided inside the tub body 4*a* to define a water passing space, and a balancing ring 4*c* mounted on an upper end of the tub body 4*a*. Upon rotation of the rotatable tub 4, a resultant centrifugal force raises water therein, which is then discharged into the water-receiving tub 2 through dehydration holes (not shown) formed in the upper portion of tub 4.

A drain hole 7 is formed in the right-hand bottom of the water-receiving tub 2, as viewed in FIG. 2. A drain valve 8 is provided in the drain hole 7. A drain hose 9 is connected to the drain hole 7. The drain valve 8 is a motor operated valve closed and opened by a geared motor 43 (see FIG. 8) serving as drain valve drive means, as will be described later. An auxiliary drain hole 7*a* is formed in the left-hand bottom of the water-receiving tub 2, as viewed in FIG. 2. The auxiliary drain hole 7*a* is connected through a connecting hose (not shown) to the drain hose 9. The auxiliary drain hole 7*a* is provided for draining water which is discharged through the dehydration holes in the upper portion of the rotatable tub 4 into the water-receiving tub 2 upon rotation of the rotatable tub 4 for the dehydration operation.

Figure 2:
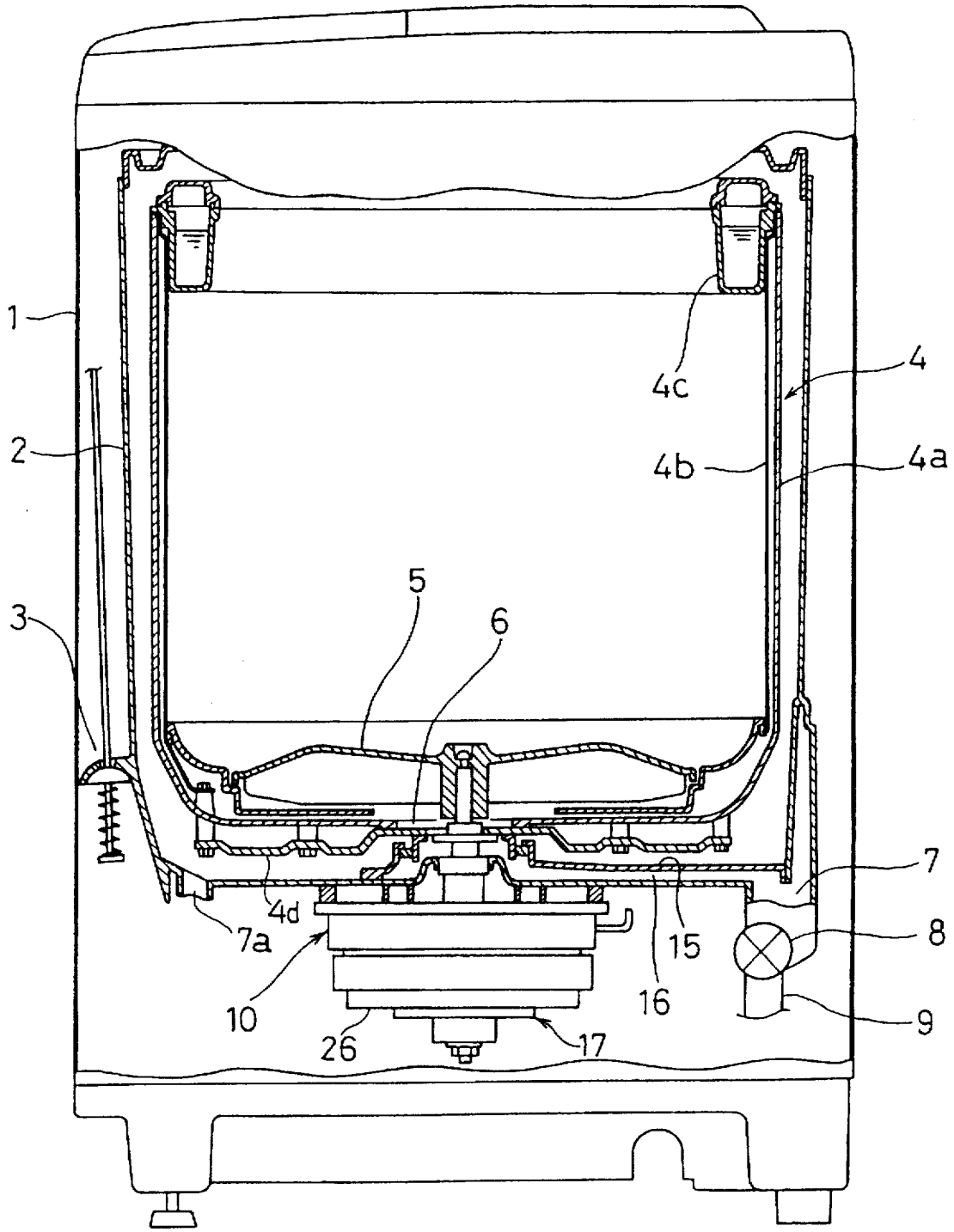
FIG. 2 is a longitudinal side section of the washing machine.

Referring to FIG. 1, a mechanism housing 10 is mounted on an outer bottom of the water-receiving tub 2. The mechanism housing 10 is formed in its central portion with a shaft support cylinder 11 vertically extending. A hollow tub shaft 12 is inserted in the shaft support cylinder 11 to be supported on bearing members such as ball bearings 13*a* and 13*b* for rotation. An agitator shaft 14 is inserted in the tub shaft 12 to be supported on bearing members such as metal bearings 14*a* and 14*b* for rotation. Upper and lower ends of the agitator shaft 14 extend out of the tub shaft 12. The upper end of the shaft support cylinder 11 of the mechanism housing 10 is fitted in a through hole 2a formed in the central bottom of the water-receiving tub 2 with a seal 11a providing watertightness therebetween. The seal 11a also provides watertightness between an outer circumferential surface of the tub shaft 12 and the upper end of the shaft support cylinder 11. The tub shaft 12 has an integrally formed flange 12a on the upper end thereof. The rotatable tub 4 is fixed to a mounting plate 4d further fixed to the flange 12a so that the rotatable tub 4 is rotated with the tub shaft 12. The agitator 5 is fixed to the upper end of the agitator shaft 14 so as to be rotated therewith, as is shown in FIGS. 1 and 2.

A drain cover 15 extends between the central inner bottom of the water-receiving tub 2 and the drain hole 7 to define a draining passage 16 extending from a through hole 6 formed in the central bottom of the water-receiving tub 2 to the drain hole 7, as is shown in FIGS. 1 and 2. In this construction, water is stored in the rotatable tub 4 and the draining passage 16 when supplied into the tub 4 with the drain valve 8 closed. The water in the rotatable tub 4 is discharged through the hole 6, the draining passage 16, the drain hole 7, the drain valve 8, and the drain hose 9 sequentially when the drain valve 8 is opened.

Figure 3:
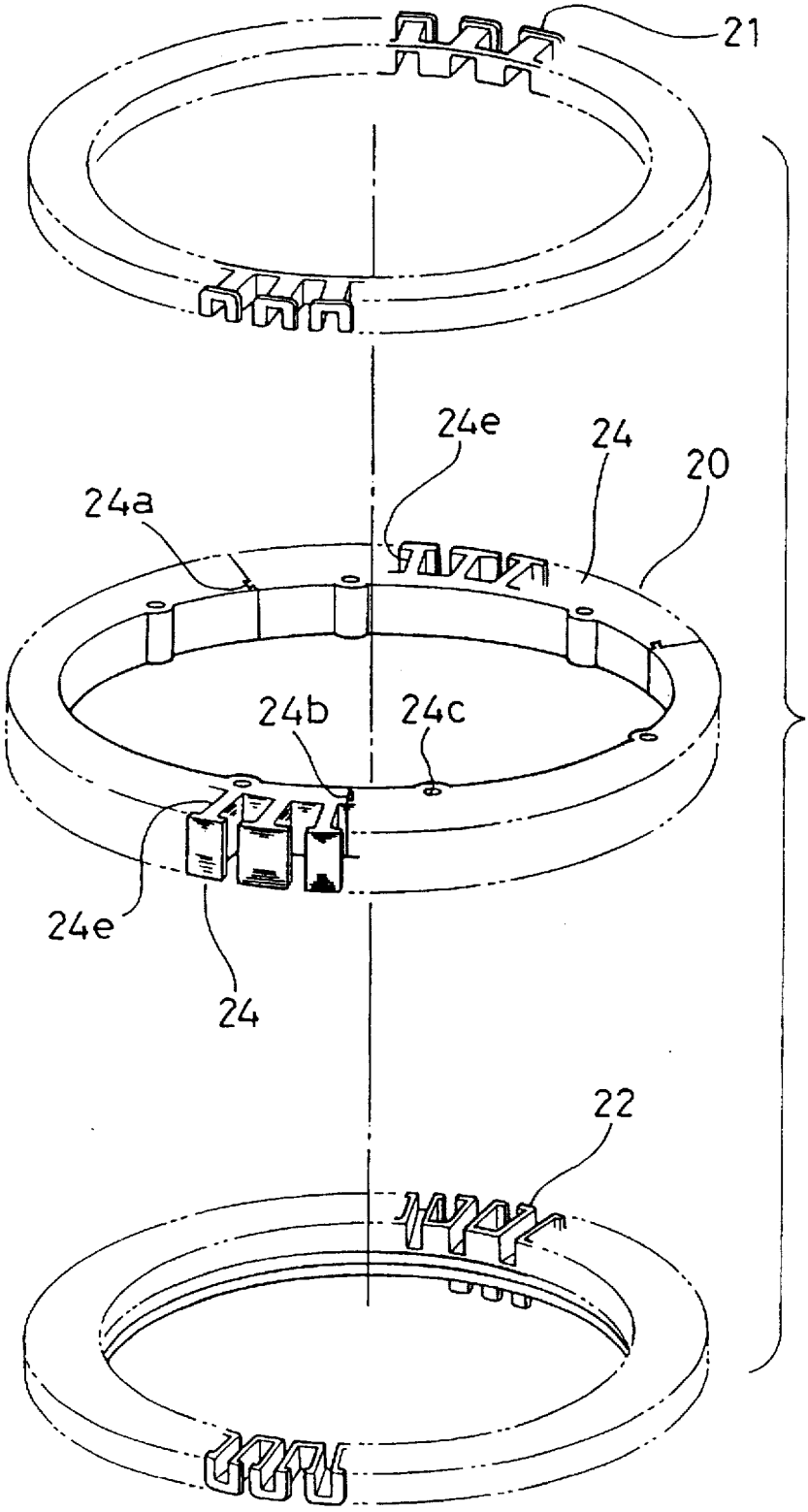
FIG. 3 is an exploded perspective view of a stator.
Figure 4:
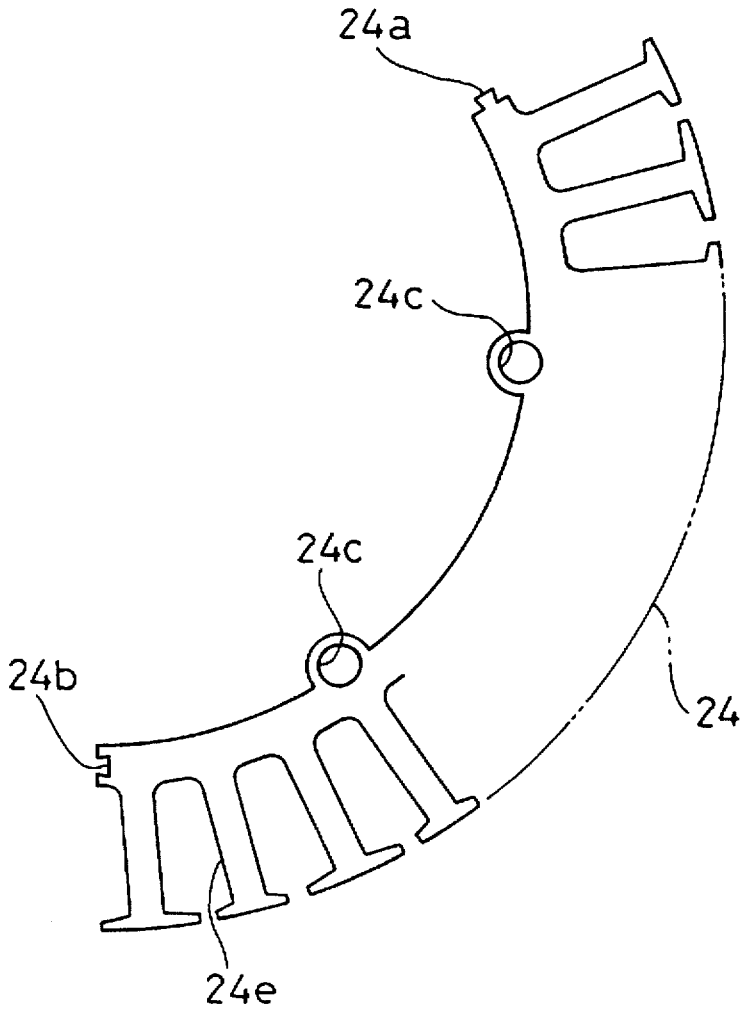
FIG. 4 is a plan view of a unit iron core.

An electric motor 17 such as an outer rotor type brushless motor wherein a rotor is located outside stator coils is mounted on the mechanism housing 10 further mounted on the outer bottom of the water-receiving tub 2. More specifically, a stator 18 of the motor 17 is mounted on the mechanism housing 10 by stepped screws 19 to be concentric with the agitator shaft 14. The stator 18 comprises a laminated iron core 20, upper and lower bobbins 21 and 22, and a winding 23 (see FIG. 1), as is shown in FIG. 3. The laminated iron core 20 comprises three generally circular arc-shaped unit iron cores 24 connected to one another into an annular shape, as shown in FIGS. 3 and 4. Each unit iron core 24 has engagement convex and concave portions 24a and 24b formed on both ends thereof respectively for the connection to the others. Furthermore, each unit iron core 24 has two screw holes 24c each having a diameter approximately equal to that of a straight portion 19c (see FIG. 1) of each stepped screw 19. The upper and lower bobbins 21 and 22 are each made of a plastic and adapted to be fitted to upper and lower teeth 24e of the laminated iron core 20 respectively. The winding 23 is wound around the outer peripheries of the bobbins 21 and 22. The stator 18 constructed as described above is mounted on the mechanism housing 10 by tightening the stepped screws 19 having passed through the respective screw holes 24c into the mechanism housing 10.

Figure 9:
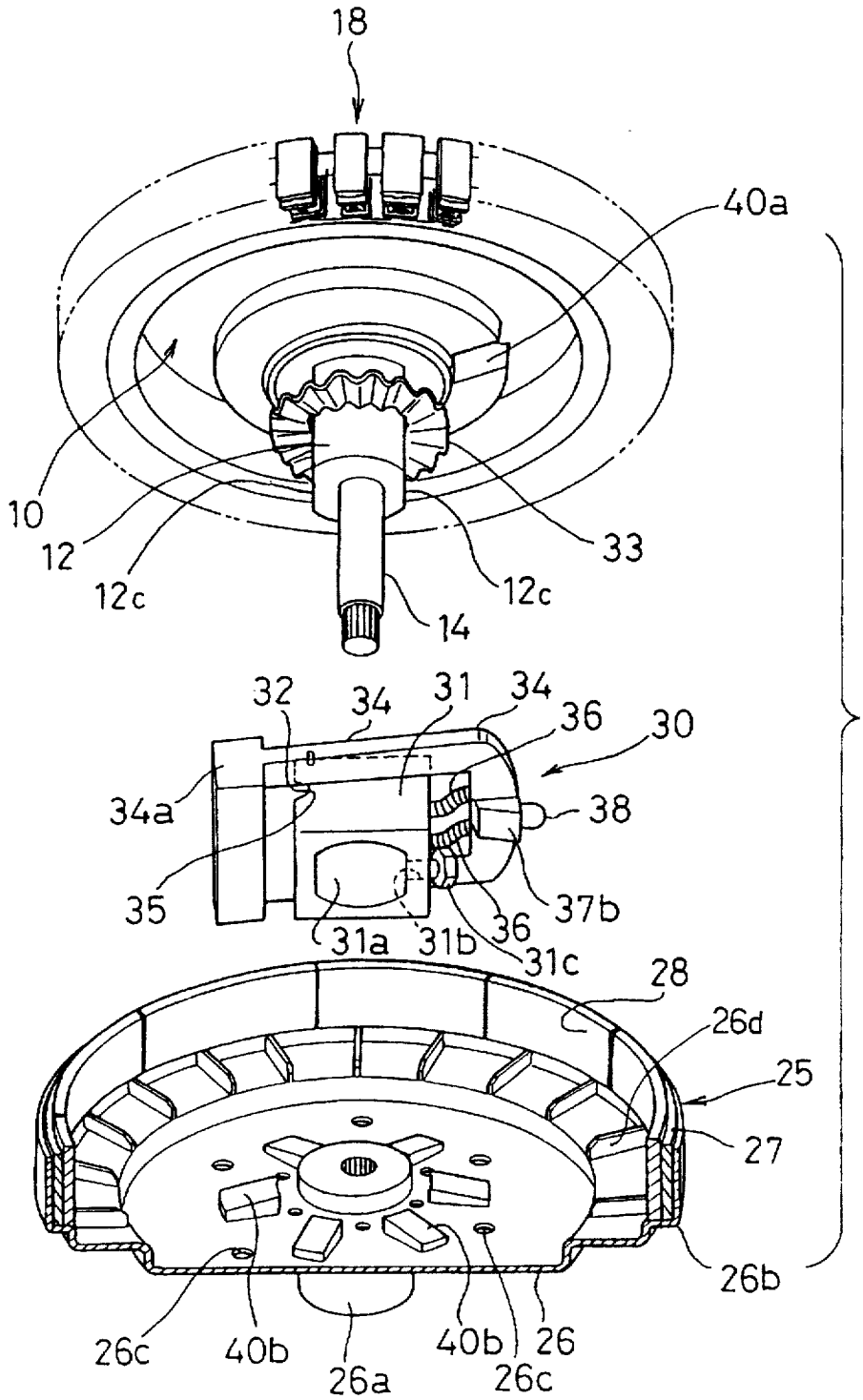
FIG. 9 is an exploded perspective view of a rotor and a stator of a motor and the clutch.

A rotor 25 of the motor 17 is mounted on the lower end of the agitator shaft 14 to be rotated therewith, as is shown in FIG. 1. The rotor 25 comprises a rotor housing 26, a rotor yoke 27, and rotor magnets 28. The rotor housing 26 is made of aluminum by die casting and has a central boss portion 26a and an outer peripheral magnet mounting portion 26b. The lower end of the agitator shaft 14 is fitted in the boss portion 26a to be fixed therein. The magnet mounting portion 26b includes a horizontal portion and a vertical portion. The rotor yoke 27 is abutted against an inner surface of the vertical portion of the magnet mounting portion 26b and further fixed by screws to horizontal portion thereof. Twelve rotor magnets 28 each of which is allocated to one pole are bonded to an inner surface of the rotor yoke 27. Upper ends of the rotor magnets 28 protrude upwardly above an upper end of the rotor yoke 27. The rotor housing 26 has a plurality of air intakes 26c formed in a central bottom thereof, as shown in FIGS. 1 and 9. Furthermore, the rotor housing 26 has a number of radially extending ribs 26d formed on an upper circumferential face thereof opposed to the winding 23 of the stator 18. The rotor housing 26 further has a plurality of convex portions 40b which are formed on the central bottom thereof to radially protrude about its axis. These convex portions 40b constitute an engaged portion.

The mechanism housing 10 includes a portion around the shaft support cylinder 11, which portion is sized so as to cover the motor 17 and inclined to be gradually lowered outwardly such that the portion constitutes an inclined portion 10a. The inclined portion 10a has an annular vertical portion 10b integrally formed on the outer peripheral edge thereof. The vertical portion 10b has a drain opening 10c formed therein to be contiguous to an upper surface of the inclined portion 10a. The vertical portion 10b is disposed so that the drain opening 10c is located outside the motor 17.

Three Hall elements (magnetic detecting elements) 29 are mounted on respective fixtures 29a which are further fixed to the underside of the mechanism housing 10, for example. One of the three Hall elements 29 is shown in FIG. 1. The Hall elements 29 serve as position detecting means for detecting a rotational position of the rotor magnets 28. The Hall elements 29 are disposed to be opposed to portions 28a of the rotor magnets 28 protruding above the upper end of the rotor yoke 27.

A clutch 30 is provided on the lower end of the tub shaft 12. The clutch 30 has a function of changing between a first mode in which the tub shaft 12 is operatively coupled to the agitator shaft 14 in a dehydration step of a washing operation so that the motor rotor 25, the agitator shaft 14 and the tub shaft 12 are rotated together and a second mode in which the tub shaft 12 is decoupled from the agitator shaft 14 in a wash step of the washing operation so that the tub shaft 12 is prevented from being rotated with the motor rotor 25 and the agitator shaft 14.

Figure 5:
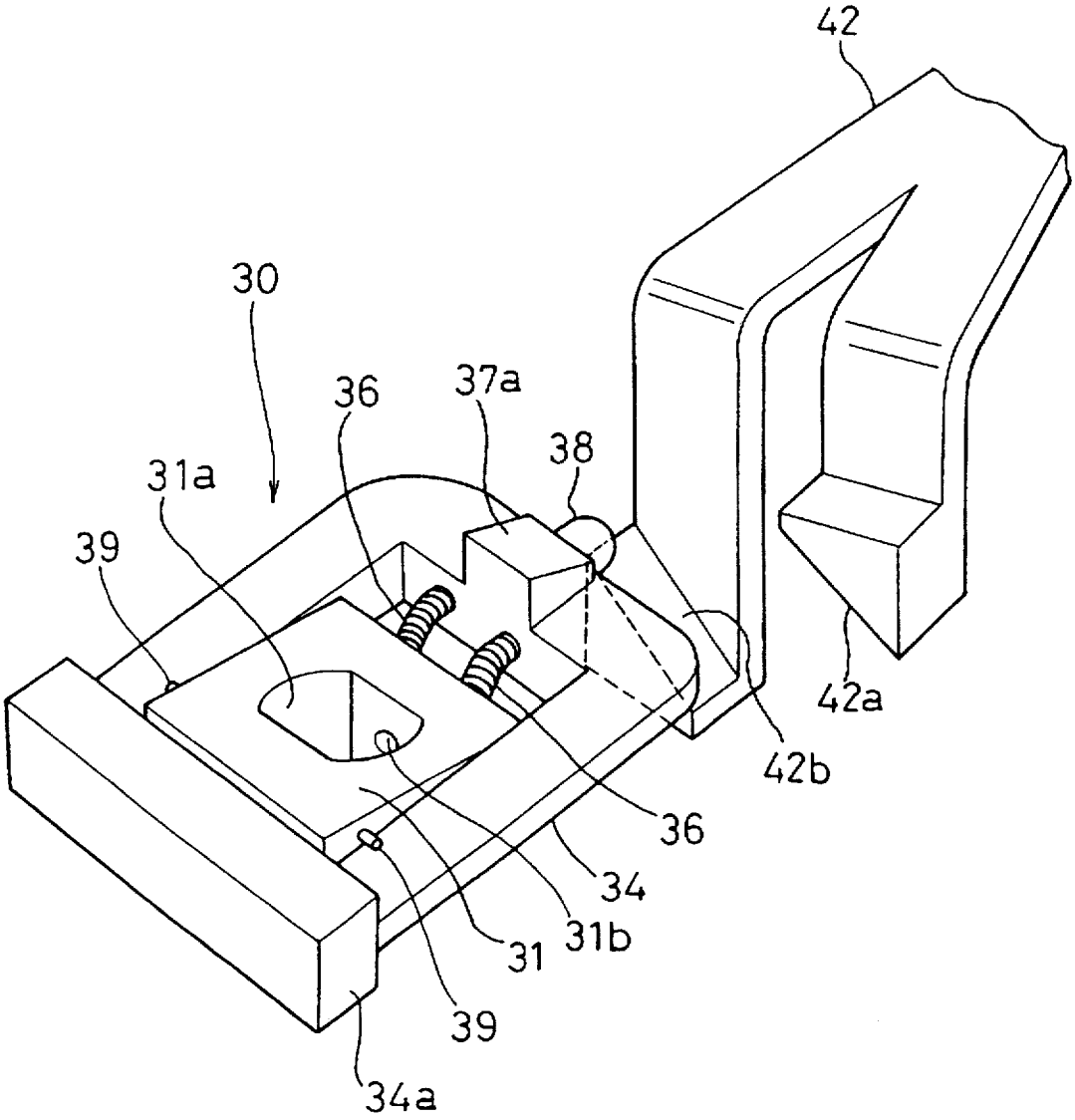
FIG. 5 is a perspective view of a clutch and a control lever.
Figure 10:
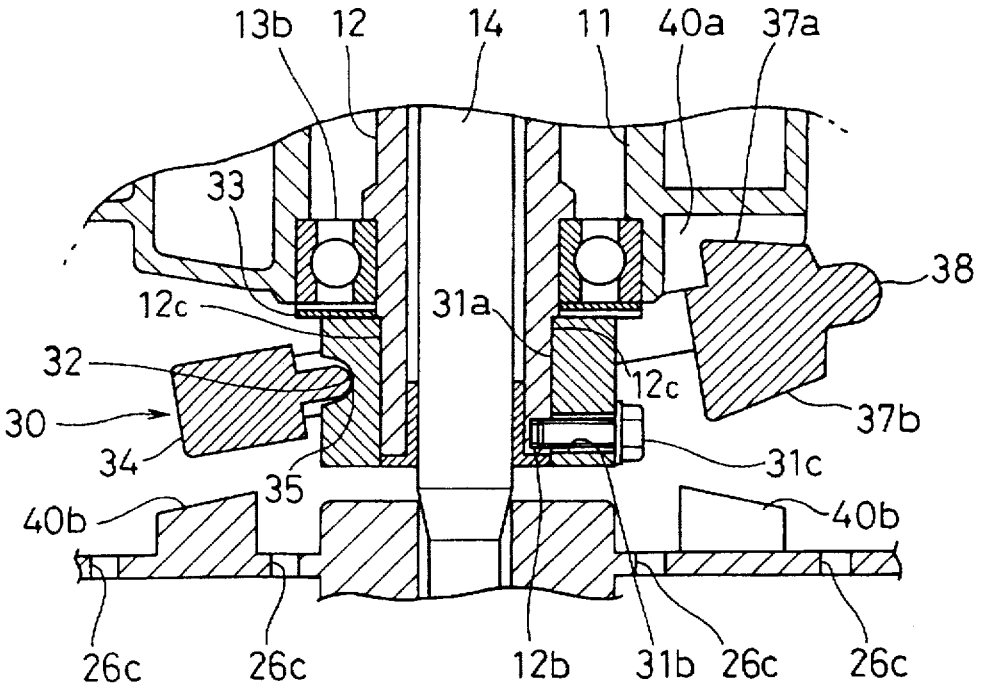
FIG. 10 is a longitudinal side section of the clutch and a mechanism around the clutch.

The clutch 30 will be described in detail. Referring to FIG. 5, the clutch 30 comprises a generally rectangular frame-shaped change-over lever 34 and a holder 31 provided inside the lever 34. The tub shaft 12 has two flat faces 12c formed on a lower outer circumferential surface thereof to be opposed to each other, as shown in FIGS. 9 and 10. One of the flat faces 12c is formed with a female thread 12b. The holder 31 has a central fitting hole 31a having inner surfaces against which the flat faces 12a of the tub shaft 12 are abutted. The holder 31 further has a screw hole 31b formed to correspond in its position to the female thread 12b of the tub shaft 12. The holder 31 further has a pivot concave portion 32 formed in the left-hand outer surface thereof to have an approximately semicircular section, as viewed in FIG. 10. The lower end of the tub shaft 12 including the flat faces 12c is fitted into the fitting hole 31a of the holder 31 so that the holder 31 is rotated with the tub shaft 12. In this condition, a screw 31c is caused to pass through the screw hole 31b and then engaged with the female thread 12b so that the holder 31 is fixed to the tub shaft 12. Furthermore, the tub shaft 12 is provided with a corrugated washer 33 serving as pressing means. The washer 33 is located around the flat faces 12a of the tub shaft 12 between the holder 31 and the lower bearing 13b. The corrugated washer 33 is adapted to press the lower bearing 13b axially of the tub shaft 12 or upwardly in the embodiment.

The change-over lever 34 constitutes a change-over member. The change-over lever 34 is fitted into the holder 31 so as to be rotated therewith, as is shown in FIGS. 5 and 9. The change-over lever 34 has in the inside of one end 34a thereof (a left-hand end in FIGS. 5 and 9) a pivot convex portion 35 having a distal end of an approximately semicircular section. The pivot convex portion 35 is fitted into the pivot concave portion 32 of the holder 31 so that the change-over lever 34 is pivotable or rotatable upwardly and downwardly about the portion 35.

Two toggle type springs 36 each comprising a compression coil spring are provided between the holder 31 and the change-over lever 34, as are shown in FIGS. 5 and 9. The toggle type springs 36 hold the change-over lever 34 at an upper position (see FIGS. 1 and 10) when the same is rotated upwardly and at a lower position (see FIG. 6) when the same is rotated downwardly. The change-over lever 34 has convex portions 37*a* and 37*b* formed on the upper and lower portions of an end thereof (a right-hand end as viewed in FIG. 10) respectively and an operated portion 38 protruding from an outside surface of the end.

Figure 11:
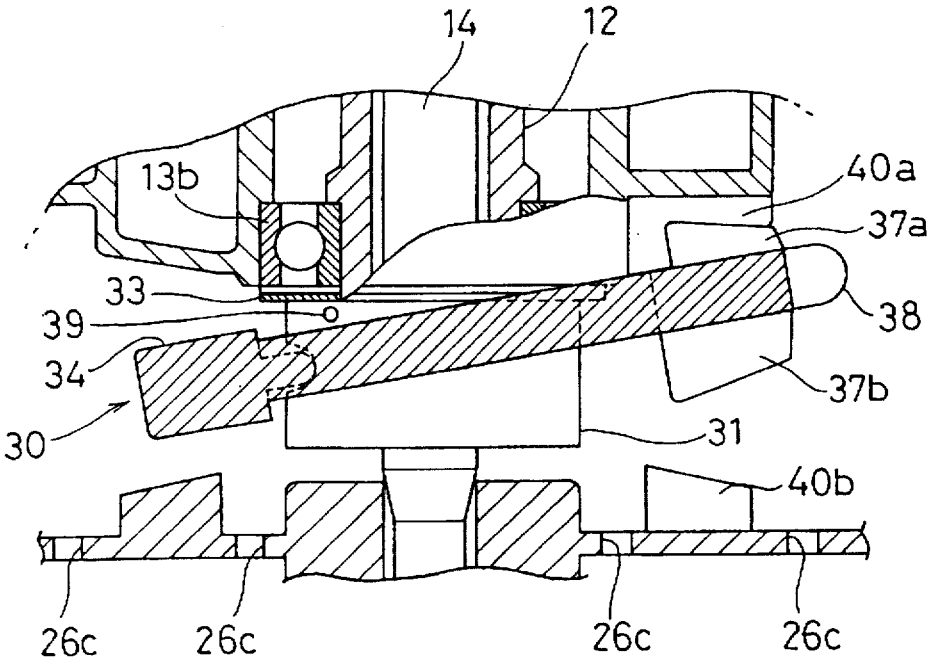
FIG. 11 illustrates the clutch and one of stoppers.

The holder 31 has stoppers 39 protruding from opposite side surfaces thereof respectively, as shown in FIG. 5. When the change-over lever 34 and the holder 31 have been assembled to constitute the clutch 30, the change-over lever 34 is abutted against the stoppers 39 so that the upward movement of the change-over lever 34 is limited. Consequently, since the change-over lever 34 and the holder 31, when incorporated in the clutch 30, can be prevented from unstably moving, the clutch 30 in its assembled state can readily be handled. Furthermore, the assembly of clutch 30 can readily be stored and mounted to the tub shaft 12. Additionally, the toggle type springs 36 can be prevented from falling off since they are not gotten into an expanded or free state. The stoppers 39 are adapted to be located so as not to interrupt the upward movement of the change-over lever 34 after the clutch 30 has been mounted to the tub shaft 12, as is shown in FIG. 11. Consequently, the clutch 30 can be prevented from being interrupted by the stoppers 39 during the operation of the washing machine.

A recess 40*a* is formed in the underside of the mechanism housing 10 serving as a stationary portion so as to be opposed to the upper convex portion 37*a*. On one hand, the upper convex portion 37*a* of the change-over lever 34 is fitted into the recess 40*a* when the change-over lever 34 is rotated upwardly, as shown in FIGS. 1 and 10 each showing the condition in the wash or rinse step, whereupon the tub shaft 12 and accordingly, the rotatable tub 4 are fixed to the mechanism housing 10 serving as the stationary portion. Thus, the recess 40*a* and the upper convex portion 37*a* constitute fixing means 40 for fixing the tub shaft 12 to the stationary portion. The tub shaft 12 is decoupled from the agitator shaft 14 so as not to be co-rotated with the latter and the motor rotor 25 when the upper convex portion 37*a* has been fitted in the recess 40*a*. The agitator shaft 14 and the motor rotor 25 are originally coupled to each other to be rotated together.

Figure 6:
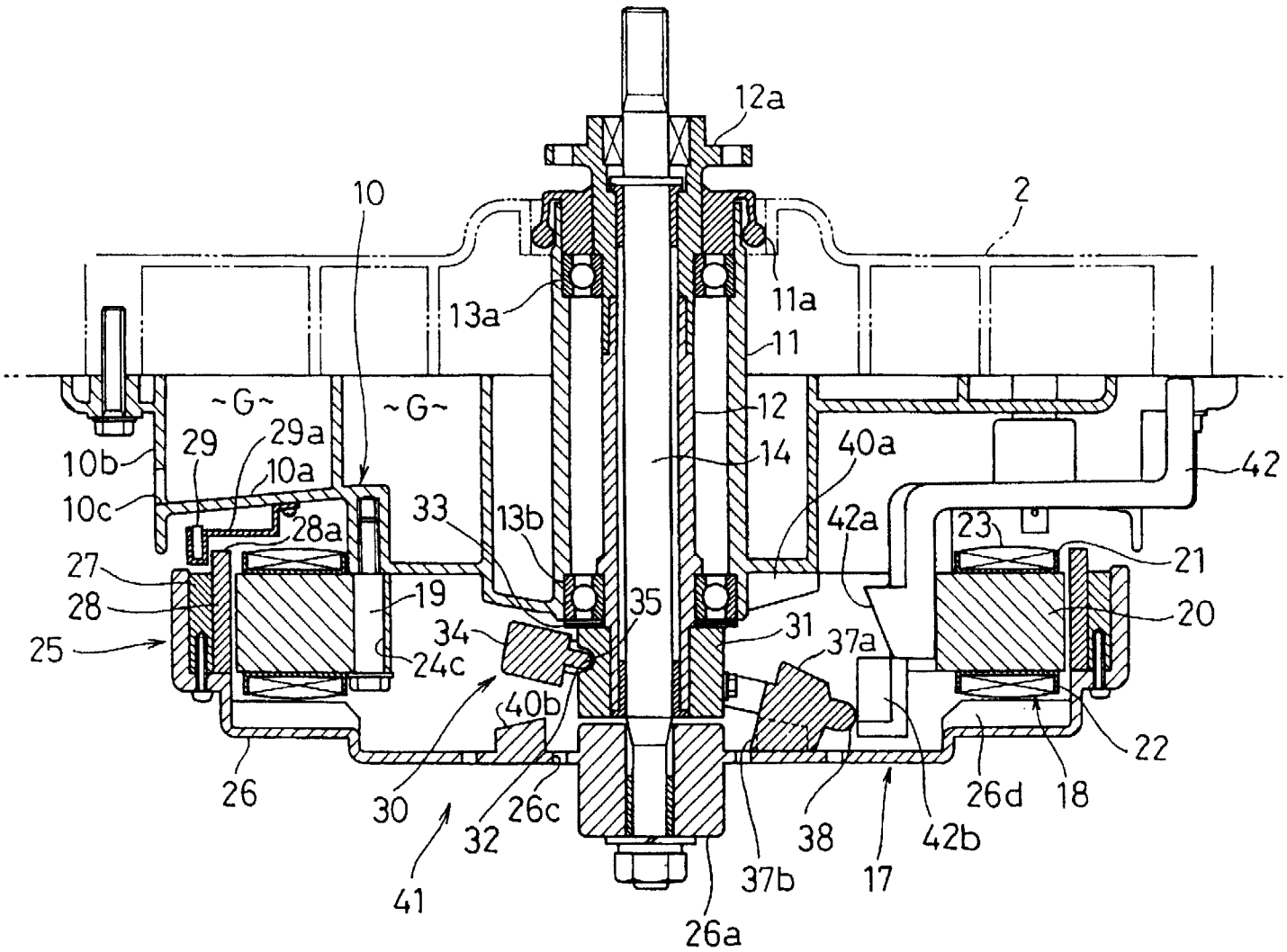
FIG. 6 is a longitudinal side section of a mechanism section with the clutch in a mode different from that in FIG. 1.

On the other hand, the lower convex portion 37*b* of the change-over lever 34 is engaged with two of the convex portions 40*b* on the upper face of the rotor housing 26 when the change-over lever 34 is rotated downwardly, as is shown in FIG. 6 showing the condition in the dehydration step. Consequently, the tub shaft 12 is co-rotated with the motor rotor 25 and the agitator shaft 14. The convex portions 40*b* of the rotor housing 26 are formed to be lined along a rotational trajectory of the lower convex portions 37*b* of the change-over lever 34. The mechanism housing 10 is mounted with a heat insulation space G between the same and the underside of the outer tub 2, whereupon dew condensation can be prevented in the mechanism housing 10 and heat generated by the motor 17 can be prevented from being transmitted to the side of the water-receiving tub 2.

The tub shaft 12, the agitator shaft 14, the motor 17, and the clutch 30 all as described above are directly or indirectly mounted on the mechanism housing 10 to be composed into an integral mechanism unit 41. The mechanism unit 41 is, after being previously composed into the unit, mounted to the outer bottom of the water-receiving tub 2. An assembly sequence will be briefly described. The agitator shaft 14 and the metal bearings 14*a* and 14*b* are previously mounted on the tub shaft 12. The tub shaft 12 and the ball bearings 13*a* and 13*b* are then mounted on the shaft support cylinder 11 of the mechanism housing 10. The clutch 30 is mounted on the lower end of the tub shaft 12 and the stator 18 of the motor 17 is then mounted on the underside of the mechanism housing 10. The rotor 25 of the motor 17 is then mounted on the lower end of the agitator shaft 14, whereby the mechanism unit 41 is assembled. Subsequently, the mechanism housing 10 of the mechanism unit 41 is screwed to the outer bottom of the water-receiving tub 2.

Figure 7:
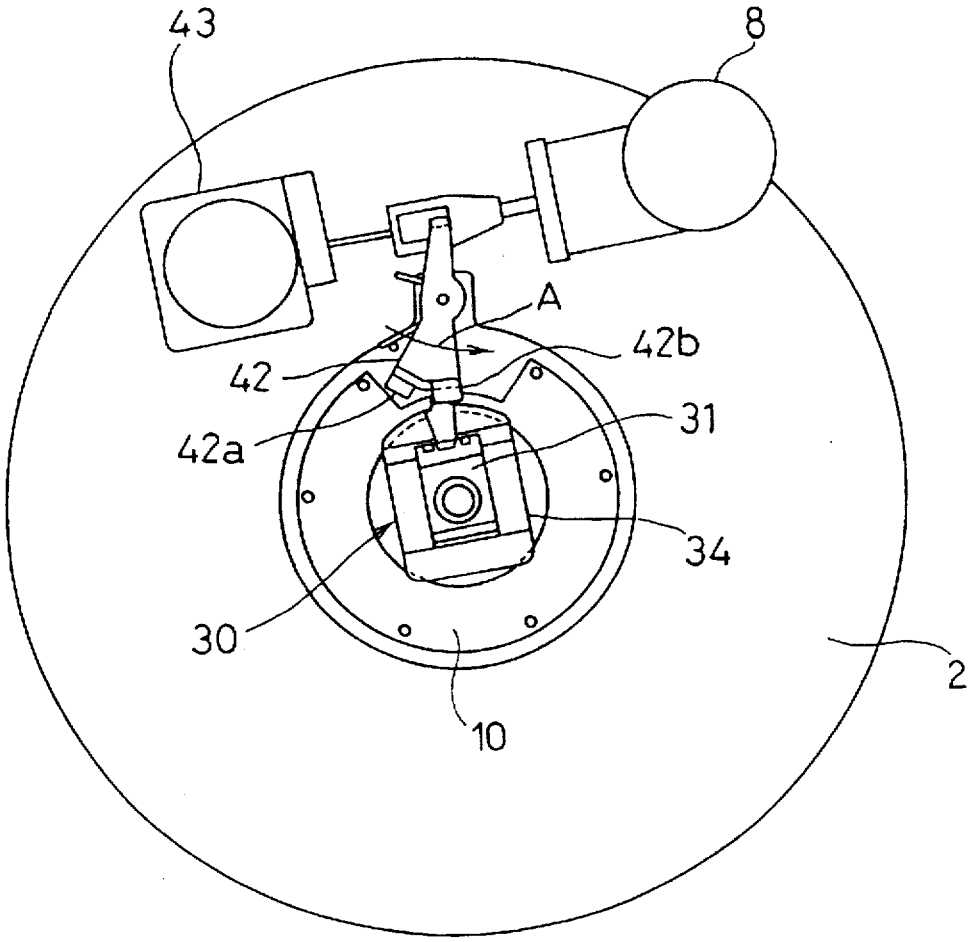
FIG. 7 is a bottom view of the water-receiving tub, showing the clutch in an operating condition.
Figure 8:
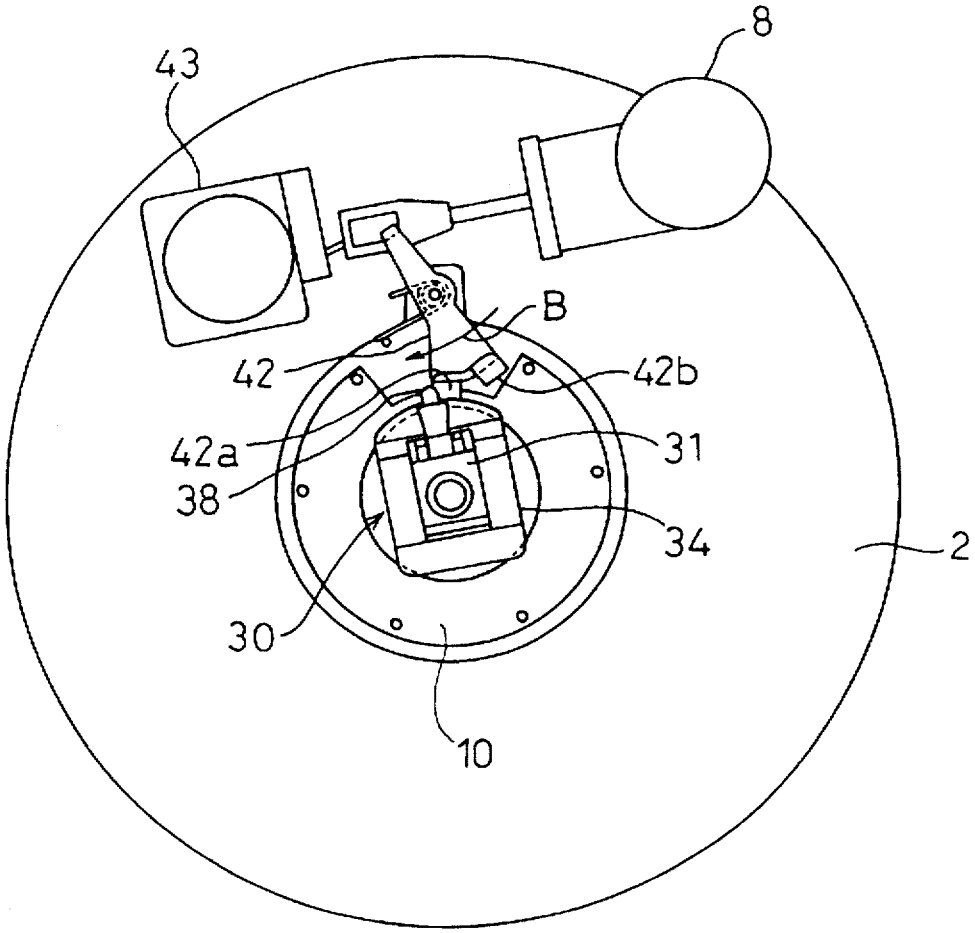
FIG. 8 is a view similar to FIG. 7, showing the clutch in another operating condition.

A control lever 42 is mounted at its one end on the right-hand end of the mechanism housing 10 to be pivotable, as viewed in FIG. 1. The control lever 42 has bifurcated portions at the other end thereof, as is shown in FIG. 5. One of the bifurcated portions of the lever 42, which is a right-hand one in FIG. 5, has a downwardly inclined surface 42*a* on its distal end, whereas the other bifurcated portion thereof, which is a left-hand one in FIG. 5, has an upwardly inclined surface 42*b* on its distal end. The control lever 42 is caused to pivot in the direction of arrow A in FIG. 7 upon energization of a geared motor 43 serving as drain valve drive means. A return spring (not shown) for the drain valve 8 causes the control lever 42 to pivot in the direction of arrow B in FIG. 8 upon deenergization of the geared motor 43. When the control lever 42 is caused to pivot in the direction of arrow A in the condition as shown in FIG. 7, the operated portion 38 of the change-over lever 34 is downwardly pushed by the downwardly inclined surface 42*a* of the control lever 42 such that the change-over lever 34 is rotated downwardly into the condition as shown in FIGS. 6 and 8. When the control lever 42 is caused to pivot in the direction of arrow B in the condition as shown in FIGS. 6 and 8, the operated portion 38 of the change-over lever 34 is upwardly pushed by the upwardly inclined surface 42*b* of the control lever 42 such that the change-over lever 34 is upwardly rotated into the condition as shown in FIGS. 1 and 7. The drain valve 8 is opened when the control lever 42 assumes the position as shown in FIGS. 6 and 8, which position corresponds to the dehydration step. The drain valve 8 is closed when the control lever 42 assumes the position as shown in FIGS. 1 and 7, which position corresponds to the wash or rinse step. Each of FIGS. 7 and 8 schematically illustrates the bottom of the water-receiving tub 2 with the motor rotor 25 and stator 18 being removed from the mechanism unit 41.

According to the above-described embodiment, on one hand, the change-over lever 34 of the clutch 30 is upwardly rotated in the wash or rinse step of the washing operation so that the agitator shaft 14 and accordingly, the agitator 5 are directly driven by the rotor 25 of the motor 17. In this case, the motor 17 directly drives the agitator 5 so that the latter is rotated repeatedly alternately forward and backward at a low speed set in accordance with washing conditions including a quantity of laundry to be washed and a cloth quality of the laundry. On the other hand, the change-over lever 34 of the clutch 30 is downwardly rotated in the dehydration step of the washing operation so that both of the agitator and tub shafts 14 and 12 and accordingly, both of the agitator 5 and the rotatable tub 4 are directly rotated at a high speed set in accordance with the washing conditions such as the quantity of laundry and the cloth quality thereof. Since a direct drive structure is thus provided, a belt transmission mechanism and a gear reduction mechanism can be eliminated. Consequently, reductions in the weight and size of the washing machine and noise produced therein can be achieved. Furthermore, since the rotatable tub 4 and the agitator 5 are directly driven without a belt transmission mechanism, the loss in the transmitted rotating force can be reduced and the maintenance of belt tension is not required. Furthermore, vibration caused during the dehydration step can be reduced since the equipments such as the motor 17 are concentrically provided around the rotatable tub 4. The construction of the clutch 30 can be simplified since it is composed of the change-over lever 34 and the holder 31. The reliability of operation of the clutch 30 can be improved since the clutch 30 is held in each of the two working conditions thereof by the toggle type springs 36.

In the above-described embodiment, particularly, the tub shaft 12, the agitator shaft 14, the motor 17, and the clutch 30 are mounted on the mechanism housing 10 to be composed into the integral mechanism unit 41. Accordingly, these parts are first assembled into the mechanism unit 41. Thereafter, the mechanism housing 10 with the previously assembled mechanism unit 41 is mounted to the outer bottom of the water-receiving tub 2 such that the mechanism unit 41 can be mounted on the water-receiving tub 2. Consequently, the parts assembling work can be simplified, which results in a great improvement in the assembling efficiency. Furthermore, the change-over lever 34 of the clutch 30 is actuated by the geared motor 43 serving as the drain valve drive means for driving the drain valve 8. Thus, the change-over lever 34 and the drain valve 8 are driven by a common drive source. This simplifies the construction of the washing machine. Additionally, since the drain valve 8 is driven by the geared motor 43 to be opened in the dehydration step, the clutch 30 can be reliably changed over in the dehydration step. Consequently, a control manner for changing over the clutch 30 can be simplified and reliably executed.

The control lever 42 is rotated to thereby rotate the change-over lever 34 upwardly or downwardly. More specifically, the upwardly inclined surface **42*b* of the control lever 42 is rotated so that the change-over lever 34 is upwardly rotated, whereas the downwardly inclined surface 42*a* of the control lever 42 is rotated so that the change-over lever 34 is downwardly rotated. Consequently, the change-over lever 34 can be readily operated by a simple construction. Additionally, the change-over lever 34 is formed with the convex portion 37*a* and the mechanism housing 10 as the stationary portion is formed with the recess 40*a*. Upon an upward movement of the change-over lever 34, the convex portion 37*a* is fitted into the recess 40*a* such that the tub shaft 12 is fixed to the mechanism housing 10. Thus, since the fixing means 40 comprising the convex portion 37*a* and the recess 40*a* is provided, the tub shaft 12 can reliably be fixed in the wash or rinse step. Moreover, the fixing means 40 can reliably prevent a tendency for the rotatable tub 4** to be rotated with streams of wash liquid and the laundry during the wash or rinse step.

According to the above-described embodiment, furthermore, the rotor housing 26 of the rotor 25 has the air intakes **26*c* and the ribs 26*d* formed to be located below the winding 23 of the stator 18. The ribs 26*d* serve as a fan when the motor 17 is energized for rotation of the rotor 25 thereof in the wash or dehydration step. Air outside the motor 17 is drawn into the side of the stator 18 through the air intakes 26*c* and then directed to the winding 23 by the ribs 26*d*. Consequently, a sufficient cooling effect can be achieved for the motor 17. Furthermore, since the mechanism housing 10 is sized to cover the motor 17, the motor 17 can be prevented from being wet by the mechanism housing 10 even when water drops resulting from dew condensation or the like fall from the underside of the water-receiving tub 2. Consequently, the deterioration in the insulation can be prevented in the motor 17. Furthermore, since the mechanism housing 10 is inclined so as to be gradually lowered outwardly, water drops adherent to the mechanism housing 10 are caused to flow along the inclined face thereof. Consequently, water can be prevented from remaining on the mechanism housing 10. Moreover, since the drain hole 10*c* is formed in the mechanism housing 10 located outside the motor 17, water adherent to the mechanism housing 10 can be discharged outside through the drain hole 10*c*, and the motor 17** can reliably be prevented from being wet during the water discharge.

Furthermore, since the holder 31 of the clutch 30 is provided with the stoppers 39 limiting the upward movement of the change-over lever 34, it is abutted against the side of the stoppers 39 in the mounting of the clutch 30 so that the movement of the change-over lever 34 is prevented. Consequently, the assembly of clutch 30 can readily be handled since the movement of the change-over lever 34 relative to the holder 31 is prevented during the handling of the assembly of clutch 30. Additionally, each toggle type spring 36 can be prevented from falling off since the movement of the change-over lever 34 is prevented. Furthermore, the tub shaft 12 is formed with the female thread **12*b* with which the screw 31*c* is, after having passed through the screw hole 31*b* of the holder 31, engaged so that the holder 31 is fixed to the tub shaft 12. Consequently, the holder 31 can readily be fixed. Moreover, since a screwing force acts to draw the tub shaft 12 to the side of the holder 31, the force is not exerted upon the metal bearing 14*a* such that a better bearing performance can be expected. If the holder 31 should be formed with a female thread extending therethrough and a screw should be engaged with the female thread so that its distal end presses the tub shaft 12 to fix the same, an axial force would be applied to the tub shaft 12 from the outside thereof and the metal bearing 14*a*** would be subjected to an external force such that the better bearing performance could not be expected. In the foregoing embodiment, however, such inconvenience can be overcome.

Figure 12:
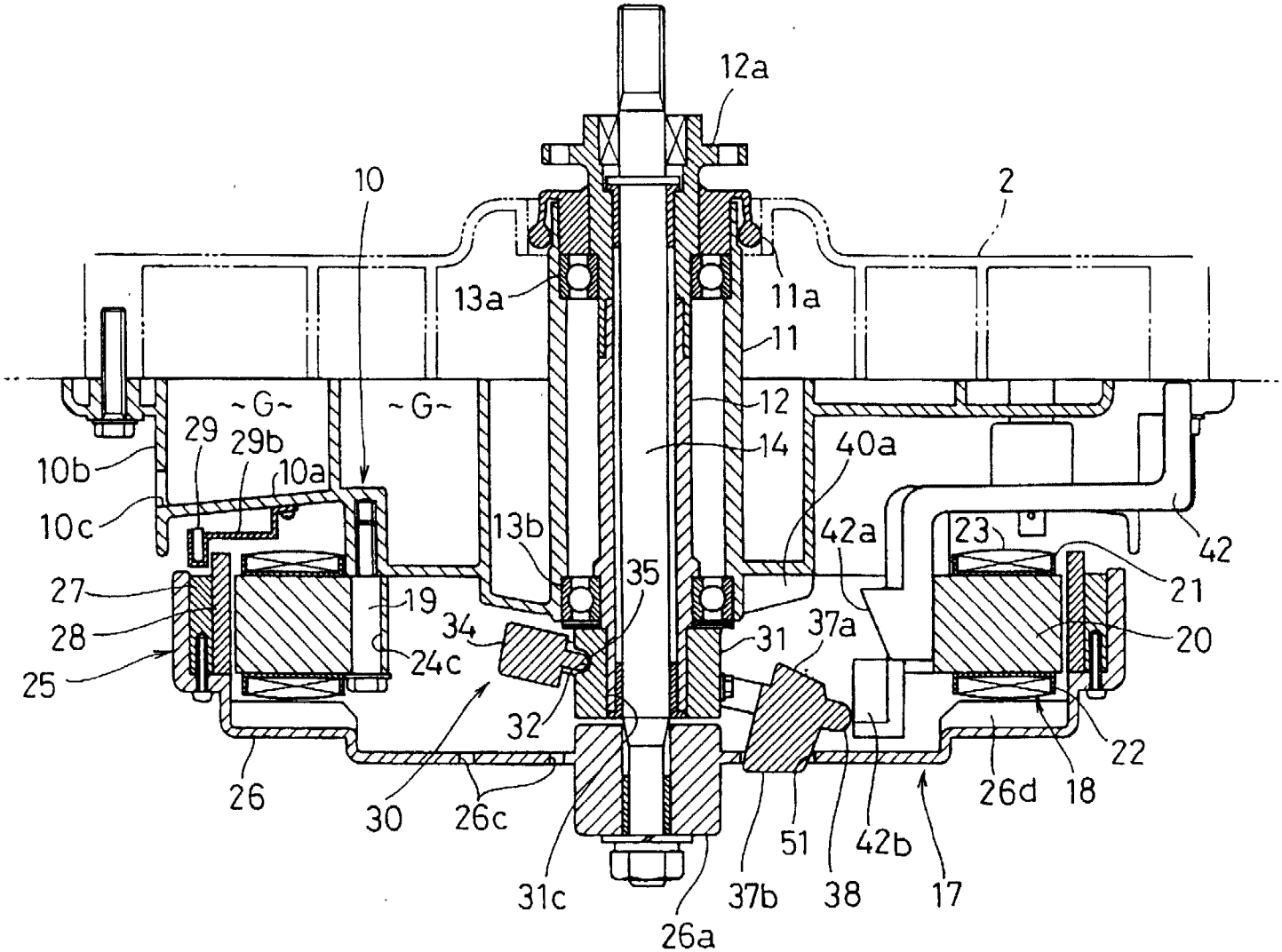
FIG. 12 is a view similar to FIG. 6, showing a second embodiment in accordance with the present invention.

FIG. 12 illustrates a second embodiment of the present invention. The differences between the first and second embodiments will be described. The identical or similar parts are labeled by the same reference symbols in the second embodiment as those in the first embodiment in the second embodiment, an engagement hole 51 is formed in the rotor housing 26 for the motor rotor 25, instead of the convex portion **41*b* in the first embodiment. The lower convex portion 37*b* of the change-over lever 34 is fitted into the engagement hole 51 when the change-over lever 34 is downwardly rotated. The other construction in the second embodiment is the same as that in the first embodiment. Accordingly, the same effect can be achieved in the second embodiment as in the first embodiment. Particularly in the second embodiment, the engagement hole 51 can also serve as an air intake for the cooling of the motor 17**.

Figure 13:
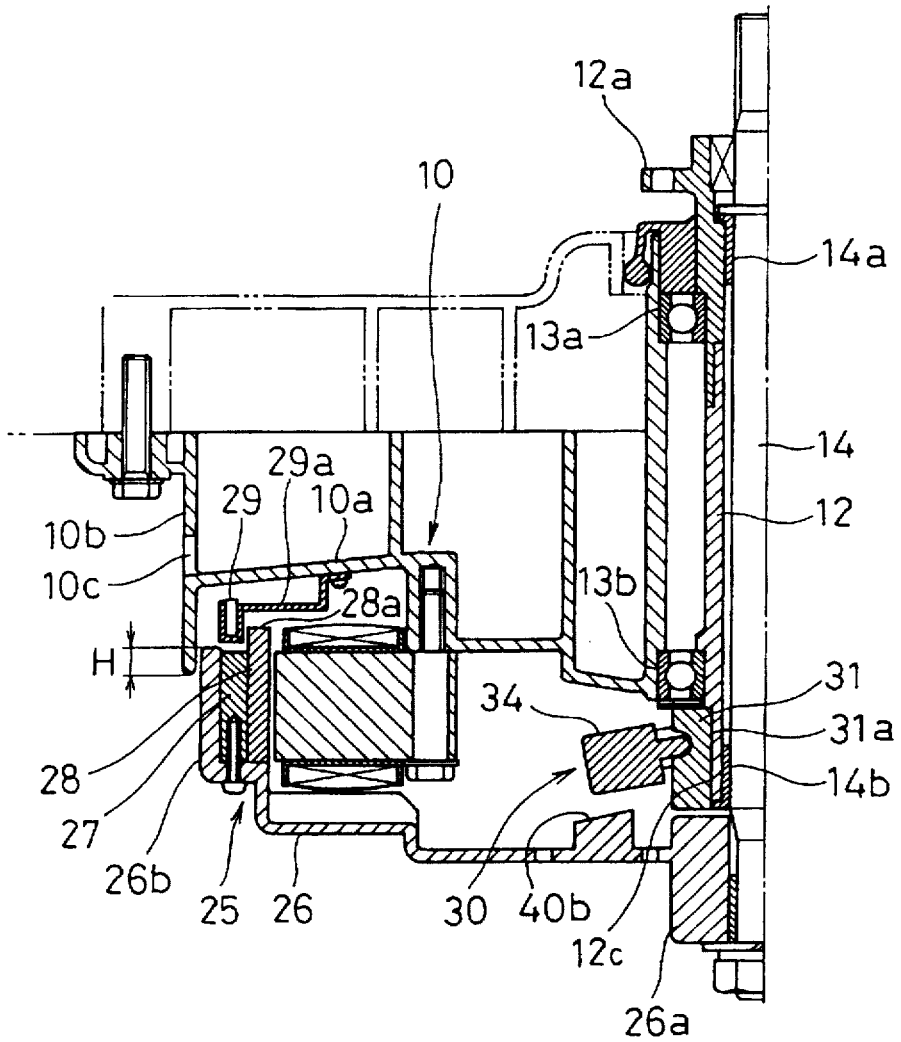
FIG. 13 is a longitudinal side section of the mechanism unit in a third embodiment in accordance with the present invention.

FIG. 13 illustrates a third embodiment of the present invention. The differences between the first and third embodiments will be described. The identical or similar parts are labeled by the same reference symbols in the third embodiment as those in the first embodiment. In the third embodiment, the lower end of the vertical portion 10*b* of the mechanism housing 10 is located outside the outer circumference of the rotor housing 26 of the motor 17 such that both of them are overlapped. The height of the overlapped portion is designated by reference symbol H. The other construction in the third embodiment is the same as that in the first embodiment. Accordingly, the same effect can be achieved in the third embodiment as in the first embodiment. Particularly in the third embodiment, the motor 17 can be further prevented from being wet since the lower end of the vertical portion 10*b* of the mechanism housing 10 and the outer circumference of the rotor housing 26 are overlapped.

Figure 14:
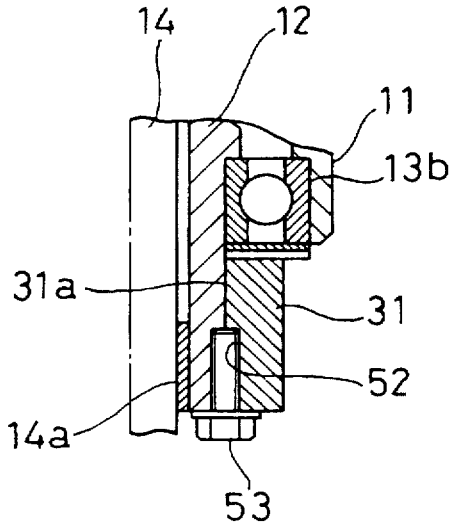
FIG. 14 is a longitudinal side section of the tub shaft and the holder in a fourth embodiment in accordance with the present invention.
Figure 15:
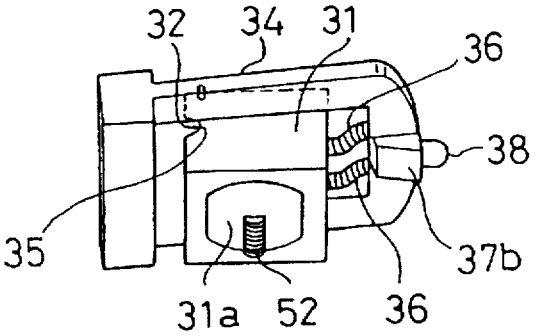
FIG. 15 is a perspective view of the clutch.

FIGS. 14 and 15 illustrate a fourth embodiment of the present invention. The differences between the first and fourth embodiments will be described. The identical or similar parts are labeled by the same reference symbols in the fourth embodiment as those in the first embodiment. The fourth embodiment differs from the first embodiment in the construction for fixing the holder 31 to the tub shaft 12. More specifically, a female thread 52 is formed in fit faces of the tub shaft 12 and the holder 31 so as to extend through both of them. A screw 53 is engaged with the female thread 52 so that the holder 31 is fixed to the tub shaft 12. In this embodiment, too, the metal bearing 14*a* can be prevented from being subjected to a securing force of the screw 53 such that a better bearing performance can be expected. The other construction in the fourth embodiment is the same as that in the first embodiment. Accordingly, the same effect can be achieved in the fourth embodiment as in the first embodiment.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A washing machine comprising:

an outer tub;

a rotatable tub rotatably mounted in the outer tub;

an agitator mounted in the rotatable tub;

a hollow tub shaft transmitting a rotating force to the rotatable tub;

an agitator shaft inserted in the tub shaft for transmitting a rotating force to the agitator and having a lower end;

an electric motor including a stator concentric with the agitator shaft and a rotor mounted on the lower end of the agitator shaft;

a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, the clutch having a change-over member and changes between the first and second modes on the basis of operation of the change-over member;

a mechanism housing mounted on an outer bottom of the outer tub so that the tub shaft, the agitator shaft, the motor and the clutch are mounted on the mechanism housing to be composed into an integral mechanism unit;

a drain valve provided for discharging wash liquid; and drain valve drive means for driving the drain valve and for actuating the change-over member of the clutch.

2. A washing machine comprising:

an outer tub;

a rotatable tub rotatably mounted in the outer tub;

an agitator mounted in the rotatable tub;

a hollow tub shaft transmitting a rotating force to the rotatable tub;

an agitator shaft inserted in the tub shaft for transmitting a rotating force to the agitator and having a lower end;

an electric motor including a stator concentric with the agitator shaft and a rotor mounted on the lower end of the agitator shaft;

a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft, the clutch having a change-over member and changes between the first and second modes on the basis of operation of the change-over member;

a mechanism housing mounted on an outer bottom of the outer tub so that the tub shaft, the agitator shaft, the motor and the clutch are mounted on the mechanism housing to be composed into an integral mechanism unit; and a control lever rotatably mounted on a stationary portion of the machine for actuating the change-over member of the clutch.

3. A washing machine according to claim, wherein the mechanism housing is sized so as to cover the motor and inclined so as to be gradually lowered toward the outside of the machine.

4. A washing machine according to claim, wherein the mechanism housing is sized so as to cover the motor and has a drain hole formed in a portion thereof located outside the motor.

5. A washing machine according to claim 1, wherein the change-over member has two ends and is pivotable about one of the ends thereof so that the other end side thereof is moved upwardly and downwardly.

6. A washing machine according to claim 2, wherein the change-over member is movable upwardly and downwardly and the control lever has upwardly and downwardly inclined faces moving the change-over member upwardly and downwardly respectively.

7. A washing machine according to claim 6, wherein the change-over member has a convex portion formed on a lower surface thereof and the motor rotor has an engaged portion formed in an upper surface thereof, and when the change-over member is moved downwardly, the convex portion of the change-over member is engaged with the engaged portion of the motor rotor so that the tub shaft is operatively coupled to the agitator shaft so that the rotor, the agitator shaft and the tub shaft are rotated together.

8. A washing machine according to claim 7, wherein the convex portion of the change-over member has a generally trapezoidal shape and the engaged portion of the motor rotor includes a plurality of convex portions radially protruding from the upper surface of the rotor about an axis thereof, and the convex portion of the change-over member is engaged with one of spaces defined between the convex portions of the rotor when the change-over member is downwardly moved.

9. A washing machine according to claim 6, wherein the change-over member has a convex portion formed on a lower surface thereof and the motor rotor is formed with an engaged hole, and when the change-over member is moved downwardly, the convex portion of the change-over member is engaged with the engaged hole of the motor rotor so that the tub shaft is operatively coupled to the agitator shaft so that the rotor, the agitator shaft and the tub shaft are rotated together.

10. A washing machine according to claim 2, wherein the change-over member and the stationary portion of the machine have convex and concave portions respectively, the convex and concave portions constituting fixing means for fixing the tub shaft to the stationary portion when the convex and concave portions are interfitted.

11. A washing machine comprising:

an outer tub;

a rotatable tub rotatably mounted in the outer tub;

an agitator mounted in the rotatable tub;

a hollow tub shaft transmitting a rotating force to the rotatable tub;

an agitator shaft inserted in the tub shaft for transmitting a rotating force to the agitator and having a lower end;

an electric motor including a stator concentric with the agitator shaft and having a winding and a rotor mounted on the lower end of the agitator shaft;

a clutch for changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft;

an air intake formed in the motor rotor; and a plurality of ribs formed on the rotor so as to be located below the stator winding.

12. A washing machine comprising:

an outer tub;

a rotatable tub rotatably mounted in the outer tub;

an agitator mounted in the rotatable tub;

a hollow tub shaft transmitting a rotating force to the rotatable tub;

an agitator shaft inserted in the tub shaft for transmitting a rotating force to the agitator and having a lower end;

an electric motor including a stator concentric with the agitator shaft and a rotor mounted on the lower end of the agitator shaft;

a clutch including a holder provided integrally with the tub shaft for rotation therewith, a change-over member provided on the holder to be movable upwardly and downwardly, and a toggle spring holding the change-over member at each position when the same is moved upwardly or downwardly, the clutch changing between a first mode in which the tub shaft is operatively coupled to the agitator shaft in a dehydration step so that the motor rotor, the agitator shaft and the tub shaft are rotated together and a second mode in which the tub shaft is decoupled from the agitator shaft in a wash step so that the tub shaft is prevented from being rotated with the motor rotor and the agitator shaft; and a stopper provided on the holder for limiting the upward movement of the change-over member.

13. A washing machine according to claim 12, wherein the holder of the clutch has a through hole, the washing machine further comprising holder fixing means comprising a female thread formed in the tub shaft and a screw which, after having passed through the hole of the holder, is engaged with the female thread so that the holder is fixed to the tub shaft.

* * * * *